US005673809A

United States Patent [19]

Ohmi et al.

[11] Patent Number: 5,673,809

[45] Date of Patent: Oct. 7, 1997

[54] CONTAINER CLOSURE WITH A PLASTIC LINER HAVING PROJECTIONS EXTENDING INTO DEPRESSIONS IN THE PLASTIC SHELL

[75] Inventors: Hidehiko Ohmi; Tateo Kubo; Tomoya Igarashi; Kouzo Nakamura, all of Hiratsuka, Japan

[73] Assignee: Japan Crown Cork Co., Ltd., Japan

[21] Appl. No.: 390,681

[22] Filed: Feb. 17, 1995

[30] Foreign Application Priority Data

Feb. 23, 1994 [JP] Japan ..... 6-024994

[51] Int. Cl.[6] ..... B65D 41/34

[52] U.S. Cl. ..... 215/252; 215/343

[58] Field of Search ..... 215/341–345, 215/346–349, 350, 351, DIG. 1, 329, 333

[56] References Cited

U.S. PATENT DOCUMENTS

| | | | |
|---|---|---|---|
| 721,897 | 3/1903 | Kunkel et al. | 215/329 |
| 1,937,000 | 11/1933 | Villanyi | 215/329 |
| 3,055,526 | 9/1962 | Plunkett | 215/329 |
| 3,255,907 | 6/1966 | Eddy | 215/341 X |
| 3,520,436 | 7/1970 | Vercillo | 215/348 |
| 4,209,102 | 6/1980 | Dunn et al. | 215/329 |
| 4,664,280 | 5/1987 | Whitney et al. . | |
| 4,666,053 | 5/1987 | Corcoran et al. | 215/252 |
| 4,697,716 | 10/1987 | Mumford | 215/341 X |
| 4,709,825 | 12/1987 | Mumford | 215/334 X |
| 4,721,221 | 1/1988 | Barriac . | |
| 5,004,112 | 4/1991 | McBride | 215/252 |
| 5,285,913 | 2/1994 | Morton . | |

FOREIGN PATENT DOCUMENTS

| | | |
|---|---|---|
| 875454 | 5/1953 | Germany . |
| 62-185256 | 11/1987 | Japan . |
| 63-44627 | 9/1988 | Japan . |
| 63-48704 | 9/1988 | Japan . |
| 2-4652 | 1/1990 | Japan . |
| 2123393 | 2/1984 | United Kingdom . |

*Primary Examiner*—Stephen P. Garbe

*Attorney, Agent, or Firm*—Beveridge, DeGrandi, Weilacher & Young, L.L.P.

[57] ABSTRACT

A container closure includes a plastic shell, and a liner molded by fluidizing a plastic material within the shell. Depressions are formed at circumferentially spaced positions at an upper end portion of the inner peripheral surface of the skirt wall. The depressions each have a circumferential length increased radially outwardly at least in part thereof. A plurality of projections are formed on the outer peripheral surface of the liner in correspondence with the depressions.

4 Claims, 5 Drawing Sheets

CONTAINER CLOSURE WITH A PLASTIC LINER HAVING PROJECTIONS EXTENDING INTO DEPRESSIONS IN THE PLASTIC SHELL

FIELD OF THE INVENTION

This invention relates to a container closure of a type having a plastic shell and a plastic liner molded by fluidizing a plastic material within this shell.

DESCRIPTION OF THE PRIOR ART

As are well known, container closures having a shell molded from a relatively rigid plastic such as polypropylene or rigid polyethylene, and a liner molded from a relatively flexible plastic such as flexible polyethylene or EVA (ethylene-vinyl acetate copolymer) are widely used for application to the mouth-neck portion of glass or plastic containers for soft drinks. The shell has a top panel wall and a skirt wall extending downwardly from the peripheral edge of the top panel wall. The liner is usually molded by feeding a softened molten plastic material inside the top panel wall of the shell, and then advancing a mold of a desired shape into the shell to press the plastic material into the desired shape.

In the container closure of the type described above, it is important that the liner disposed within the shell be held at a desired position within the shell fully reliably without being moved or released from this position. To fulfill this requirement, the container closures disclosed in Japanese Laid-Open Utility Model Publication No. 185256/87 and Japanese Laid-Open Patent Publication No. 4652/90 involve the contrivance of forming a plurality of depressions in the inner surface of the top panel wall of the shell, causing a plastic material to flow into these depressions in forming a liner to produce a plurality of projections on top of the liner, so as to hold the liner at a desired position within the shell by the mutual engagement of the depressions and the projections. In these container closures, the central part of the liner is fully reliably confined to the inner surface of the top panel wall of the shell owing to the mutual engagement of the depressions and projections. The peripheral edge portion of the liner, on the other hand, is not so confined, with the result that when the plastic material pressed and fluidized into a desired shape within the shell hardens, the peripheral edge portion of the liner tends to either contractedly move radially inwardly, or incline radially inwardly in a downward direction. It is the peripheral edge portion of the liner that seals the mouth-neck portion of the container under pressure by this mouth-neck portion. Accordingly, the contracted movement or inclination, if any, at the peripheral edge portion of the liner is highly likely to destroy the sealing properties of the container closure.

In the container closures disclosed in Japanese Patent Publication Nos. 44627/88 and 48704/88, an annular retainer projecting radially inwardly is formed at an upper end portion of the inner peripheral surface of the skirt wall in the shell. When the liner is to be formed, a plastic material is caused to flow into an annular space defined between the inner surface of the top panel wall in the shell and that annular retainer, and the resulting liner is held at a desired position by the retaining action of the annular retainer. In this type of container closure, the downward movement of the peripheral edge portion of the liner is inhibited by the annular retainer; however, the radially inward movement of the peripheral edge portion of the liner is not restricted, thus producing the tendency that when the plastic material pressed and fluidized into a desired shape within the shell hardens, the peripheral edge portion of the liner either contractedly moves, or inclines. Such a type of container closure also involves the following problem associated with the annular retainer: during molding of the shell itself, the annular retainer makes up an undercut. When the product is demolded, forced stripping from the mold may take place, thus making the inner peripheral edge of the annular retainer somewhat wavy. When the liner is to be molded, the mold is brought into contact with the annular retainer in order to prevent the plastic material from flowing beyond the annular retainer. Since the inner peripheral edge of the annular retainer has been made wavy, however, the outflow of the plastic material cannot necessarily be inhibited fully reliably, so that the plastic material may flow out in a stringy form. Such outflow of the plastic material would, needless to say, damage the sealing properties of the container closure badly.

SUMMARY OF THE INVENTION

A principal object of this invention is to fully reliably prevent a radially inward contracted movement or inclination from occurring at the peripheral edge portion of a liner being molded, thereby enabling the desired sealing properties to be achieved stably.

Another object of the invention is to provide a container closure which can fully and reliably prevent the stringy outflow of a plastic material pressed to form a liner.

To attain the above principal object, according to the present invention, a plurality of depressions with a circumferential length gradually increased radially outwardly in part thereof are formed at circumferentially spaced positions in an upper end portion of the inner peripheral surface of the skirt wall in the shell, and a plurality of projections defined by the plastic material caused to flow into the depressions during molding are formed on the outer peripheral surface of the liner.

As a container closure which attains the principal object, the present invention provides a container closure comprising a plastic shell having a top panel wall and a skirt wall extending downwardly from the peripheral edge of the top panel wall, and a plastic liner molded by fluidizing a plastic material within the shell, wherein:

a plurality of depressions are formed at circumferentially spaced positions at an upper end portion of the inner peripheral surface of the skirt wall, each of the depressions has a circumferential length increased radially outwardly at least in part thereof, and a plurality of projections defined by the plastic material caused to flow into the depressions during molding are formed on the outer peripheral surface of the liner.

Preferably, each of the depressions has a circumferential length increased upwardly at least in part thereof. Advantageously, the depressions are formed at equal distances in the circumferential direction. To attain the other object, it is preferred that an overhanging upper end surface extending downwardly from the inner surface of the top panel wall and a thread forming surface located below the overhanging upper end surface are formed on the inner peripheral surface of the skirt wall; an annular shoulder surface extending radially outwardly is defined between the overhanging upper end surface and the thread forming surface; the depressions are formed in the overhanging upper end surface; an internal thread is formed on the thread forming surface; and the internal diameter rc of the radially outward end surface of each depression and the internal diameter rd of the radially inward edge of the internal thread are in the relationship rc≦rd. It is also preferred that a transitional surface located between the overhanging upper end surface and the thread forming surface is also formed on the inner peripheral surface of the skirt wall, the transitional surface is in the shape of a cylinder with the internal diameter re, and the internal diameters are in the relationship rc≦re≦rd.

In the container closure of the present invention, the phenomenon that when the plastic material pressed and fluidized into a desired shape within the shell hardens, the peripheral edge portion of the liner contractedly moves or inclines radially inwardly can be surely prevented by the cooperation between the depressions formed at the upper end portion of the inner peripheral surface of the skirt wall in the shell and the projections formed on the outer peripheral surface Of the liner. Thus, a container closure having a liner of a desired shape molded and having desired sealing properties is obtained stably. It becomes possible to preclude, or minimize, undercuts due to the formation of the depressions at the upper end portion of the inner peripheral surface of the skirt wall in the shell. Therefore, the provision of the depressions would pose no problems with the molding of the shell or liner.

If the annular shoulder surface located between the overhanging upper end surface and the thread forming surface exists on the inner peripheral surface of the skirt wall of the shell, the outflow of the plastic material pressed and molded can be fully reliably prevented by bringing a desired annular surface of the mold pressing the liner into contact with the annular shoulder surface. If the transitional surface located between the overhanging upper end surface and the thread forming surface is present on the inner surface of the skirt wall of the shell, the outflow of the plastic material pressed and molded can be fully reliably prevented by bringing a desired cylindrical outer peripheral surface of the mold pressing the liner into contact with the inner peripheral surface of the cylinder constituting the transitional surface.

DETAILED DESCRIPTION OF THE PREFERRED EMBODIMENTS

Preferred embodiments of the container closure improved in accordance with the present invention will be described in greater detail with reference to the accompanying drawings.

Figure 1:
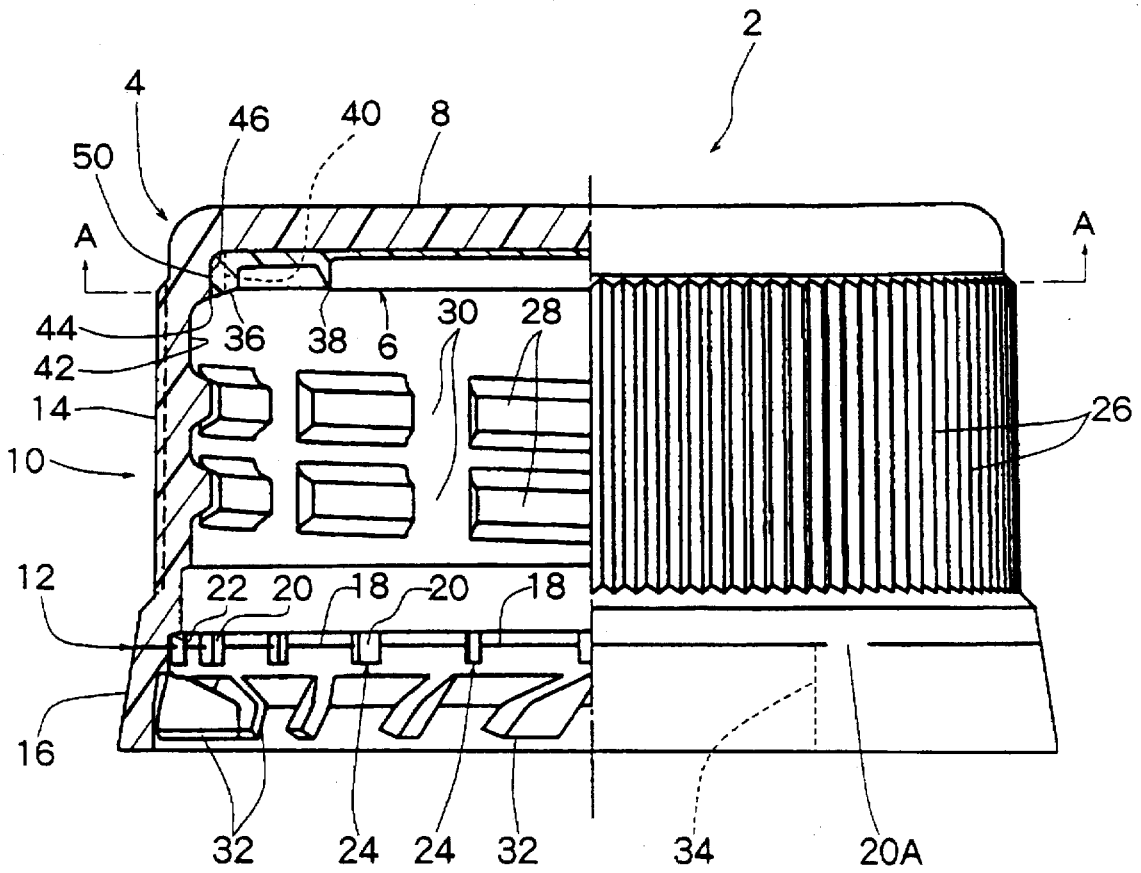
FIG. 1 is a side view partly in section of a first embodiment of the container closure improved in accordance with this invention.

With reference to FIG. 1, a container closure shown generally at 2 comprises a plastic shell 4 and a plastic liner 6. The shell 4, which may be formed by compression molding or injection molding a relatively rigid plastic such as polypropylene or rigid polyethylene, includes a nearly circular top panel wall 8 and a nearly cylindrical skirt wall 10 extending downwardly from the peripheral edge of the top panel wall 8. The skirt wall 10 has a circumferential breakable line 12 formed therein. The skirt wall 10 is thus divided into a main portion 14 above the circumferential breakable line 12, and a tamper-evident bottom portion 16 below the circumferential breakable line 12. The circumferential breakable line 12 comprises a plurality of circumferentially extending slits 18 spaced in the circumferential direction, and a plurality of bridging portions 20 located between such adjacent slits 18. One of the plurality of bridging portions 20 is a non-breakable bridging portion 20A given a larger cross sectional area than the other bridging portions to have an increased strength. If desired, all of the bridging portions 20 may be breakable bridging portions without disposing the non-breakable bridging portion 20A (in this case, an axial breakable line to be described later may be omitted). Alternatively, two or more non-breakable bridging portions may be formed. More specifically, an annular shoulder portion 22 facing downward is formed at a lower portion of the skirt wall 10 in the illustrated embodiment. The internal diameter of the skirt wall 10 below the annular shoulder portion 22 is set to be somewhat larger than its internal diameter above the annular shoulder portion 22. At a site immediately below the annular shoulder portion 22 are formed a plurality of axially extending ribs 24 spaced in the circumferential direction on the inner peripheral surface of the skirt wall 10. The circumferential breakable line 12 is formed by cutting the skirt wall 10 circumferentially with the ribs 24 being left behind. Such cutting applied from the outer peripheral surface of the skirt wall 10 does not cover the entire circumferential length, with part of the circumferential length remaining uncut. Hence, the tamper-evident bottom portion 16 below the circumferential breakable line 12 is connected to the main portion 14 above the circumferential breakable line 12 via the plurality of ribs 24 and the circumferential uncut portion that have been left uncut. The plurality of ribs 24 define the bridging portions 20, the cutting line between the adjacent ribs defines the slit 18, and the circumferential uncut portion defines the non-breakable bridging portion 20A.

On the outer peripheral surface of the main portion 14 of the skirt wall 10 are formed serrations 26 for preventing the slippage of the fingers to be engaged with that surface. On the inner peripheral surface of the main portion 14 of the skirt wall 10 is formed an internal thread 28. In the internal thread 28 are formed axially extending venting notches 30 spaced in the axial direction. On the inner peripheral surface of the tamper-evident bottom portion 16 are formed a plurality of engaging means 32 at equal distances in the circumferential direction. Each of the engaging means 32 is comprised of a flap piece projecting from the inner peripheral surface of the tamper-evident bottom portion 16 radially inwardly in an inclined manner in a direction opposite to the closing direction of the container closure 2 (the clockwise direction as viewed from above in FIG. 1) in which it is turned when mounted on the mouth-neck portion of the container in the manner to be described later. In the tamper-evident bottom portion 16 is further formed an axial breakable line 34 extending axially in proximity to one end of the non-breakable bridging portion 20A. The axial breakable line 34 may be composed of a score formed by decreasing the wall thickness, or of axially extending slits formed with spacing in the axial direction in the tamper-evident bottom portion 16. The axial breakable line 34 in the illustrated embodiment is comprised of a score formed by producing a groove extending axially in the inner peripheral surface (or outer peripheral surface) of the tamper-evident bottom portion 16.

The liner 6 molded from a relatively flexible plastic such as flexible polyethylene or EVA is advantageously molded by feeding a softened molten plastic material on the inside surface of the top panel wall 8 of the shell 4, and then inserting a compression molding tool into the shell 4 to fluidize the plastic material into a desired shape. On the lower surface of the illustrated liner 6 are formed two sealing ridges, i.e., an outside sealing ridge 36 and an inside sealing ridge 38.

The above-described constitution of the illustrated container closure 2 shows an example of a container closure improved by applying the present invention. It does not make up a novel feature of the container closure improved in accordance with the invention, but is well known to those skilled in the art. Therefore, a detailed description of this constitution will be omitted in the present specification.

Figure 2:
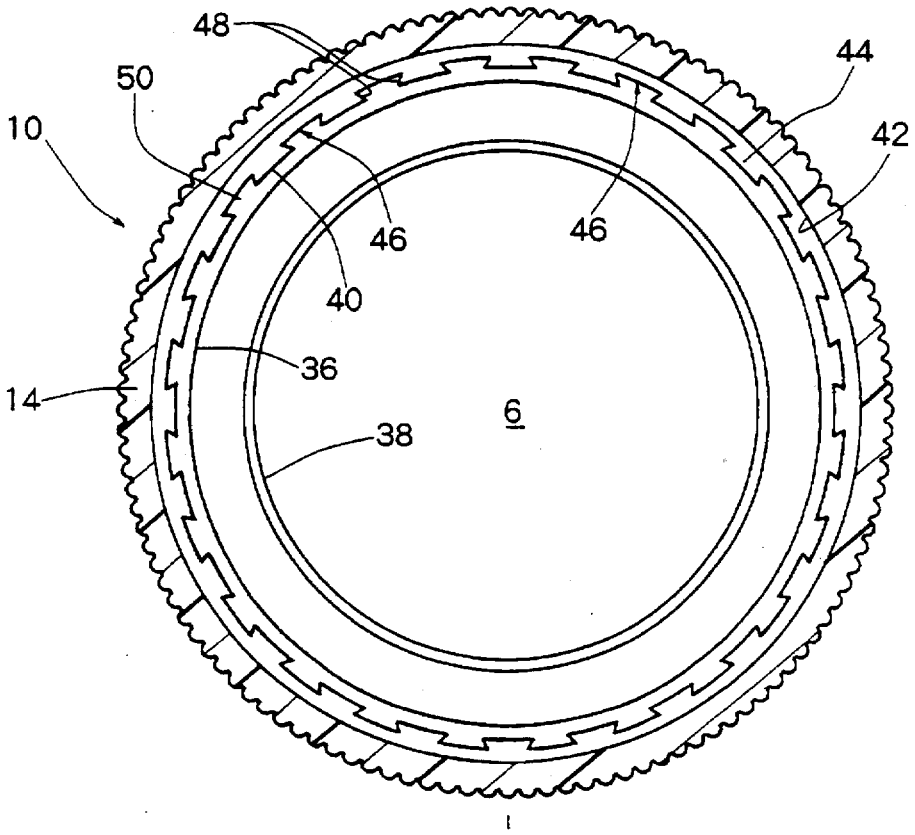
FIG. 2 is a cross sectional view taken on line A—A in FIG. 1.
Figure 3:
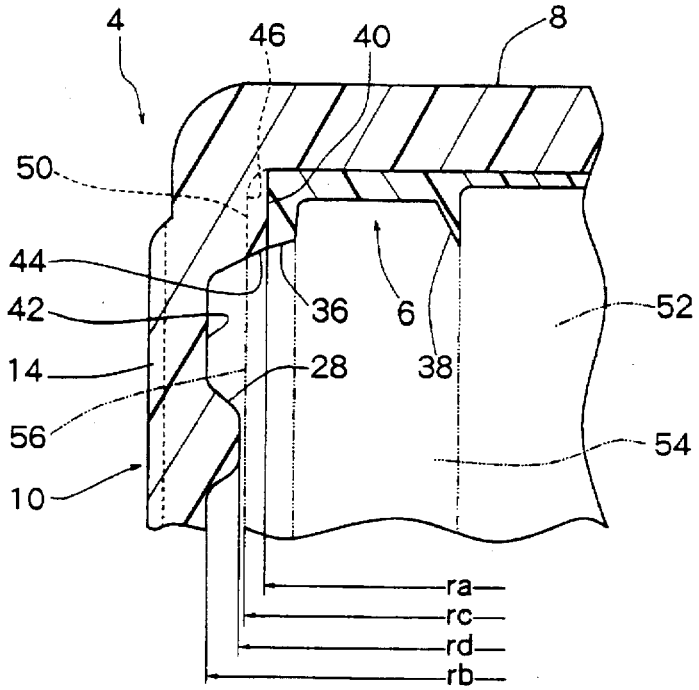
FIG. 3 is a partial longitudinal sectional view of the container closure illustrated in FIG. 1.
Figure 4:
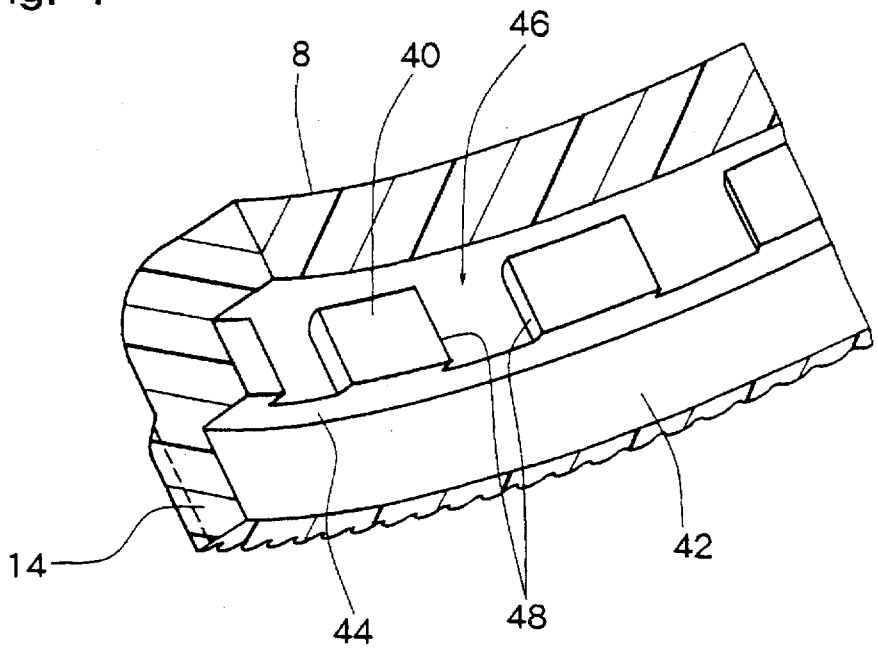
FIG. 4 is a partial perspective view Of the shell in the container closure of FIG. 1.

The illustrated container closure 2 is provided with the following improvements according to the present invention: With reference to FIGS. 2 to 4 along with FIG. 1, an overhanging upper end surface 40 extending downwardly from the inner surface of the top panel wall 8 and a thread forming surface 42 located below the overhanging upper end surface 40 are formed on the inner peripheral surface of the skirt wall 10 of the shell 4 in the container closure 2. The internal diameter ra of the overhanging upper end surface 40 is smaller than the internal diameter rb of the thread forming surface 42. An annular shoulder surface 44 extending radially outwardly from the lower end of the overhanging upper end surface 40 to the upper end of the thread forming surface 42 is defined between the overhanging upper end surface 40 and the thread forming surface 42. The aforementioned internal thread 28 is formed on the thread forming surface 42. As clearly shown in FIGS. 2 to 4, it is important that a plurality of depressions 46 be formed at circumferentially spaced positions (24 depressions at equal distances in the circumferential direction in the illustrated embodiment) in the overhanging upper end surface Advantageously, each of the depressions 46 extends upwardly from the lower end of the overhanging upper end surface 40 (accordingly, from the annular shoulder surface 44). The depressions 46 extend upwardly as far as the inner surface of the top panel wall 8, but if desired, the Upper ends of the depressions 46 may be located somewhat below the inner surface of the top panel wall 8. Both-side surfaces 48 in the circumferential direction of each depression 46 extend substantially vertically in the axial direction. In the radial direction, however, as clearly seen from FIG. 2, both-side surfaces 48 in the circumferential direction of each depression 46 are inclined circumferentially outwardly in a radially outward direction. Thus, the circumferential length of the depression 46 is gradually increased radially outwardly. In the illustrated embodiment, the circumferential length of the depression 46 is gradually increased radially outwardly in the entire radial direction and in the entire axial direction. If desired, the circumferential length of the depression 46 may be increased radially outwardly only in part of the radial direction or in part of the axial direction. As depicted in FIG. 3, it is preferred that the internal diameter rc of the outward end surface of the depression 46 is substantially equal to or smaller than the internal diameter rd of the radially inward edge of the internal thread 28 formed on the thread forming surface 42, showing the relationship $rc \leqq rd$. In this case, as will be easily understood by reference to FIG. 3, there will not be additionally formed an undercut which will cause forced mold release in the molding of the shell 4 owing to the formation of the depressions 46 in the overhanging upper end surface 40.

As noted above, the depressions 46 are formed in the overhanging upper end surface 40 on the inner peripheral surface of the skirt wall 10 in the shell 4. On the outer peripheral surface of the liner 6 molded by making the plastic material fluid in the shell 4, therefore, a plurality of (24 in the illustrated embodiment) projections 50 defined by the plastic material caused to flow into the depressions 46 are formed in correspondence with the depressions 46. In molding the liner 6, as shown by two-dot chain lines in FIG. 3, a compression molding tool comprising a columnar center punch 52, a cylindrical bushing 54 surrounding the center punch 52, and a cylindrical sleeve 56 surrounding the bushing 54 is inserted into the shell 4 to act on the plastic material, thereby making the plastic material fluid into a desired shape. When the liner 6 is to be molded, the shell 4 is usually laid in an inverted state (the state of the outside surface of the top panel wall 8 facing downward) on an anvil (not shown), and the compression molding tool is lowered to the inside of the shell 4. On this occasion, before the center punch 52 and the bushing 54 are lowered to the illustrated positions, the sleeve 56 is lowered to the indicated position so that the lower end of the sleeve 56 having an external diameter substantially equal to or slightly larger than the internal diameter rc of the outward end surface of the depression 46 is brought into intimate contact with the annular shoulder surface 44. By so doing, the outflow of the plastic material, say, in a stringy form, through the annular shoulder surface 44 can be prevented fully reliably.

In the container closure 2 improved in the aforesaid manner according to the present invention, the radially inward displacement of the peripheral edge portion of the liner 6 can be inhibited fully assuredly by the cooperative engagement between the plurality of depressions 46 formed in the overhanging upper end surface 40 on the inner peripheral surface of the skirt wall 10 in the shell 4, and the plurality of projections 50 formed on the outer peripheral surface of the liner 6 in correspondence with the depressions 46. This effect results in fully reliably preventing the peripheral edge portion of the liner 6 from either contractedly moving or inclining in the radial direction when the liner 6 molded by pressing and fluidizing the plastic material into a desired shape within the shell 4 hardens. Thus, the liner 6 having the desired satisfactory sealing properties is molded stably. Furthermore, the liner 6 is fully reliably prevented from undergoing an undesirable movement during the transportation of the container closure 2, or when the container closure 2 is mounted on the mouth-neck portion of the container in a manner to be described below, or when the container closure 2 is released from the mouth-neck portion of the container.

Figure 5:
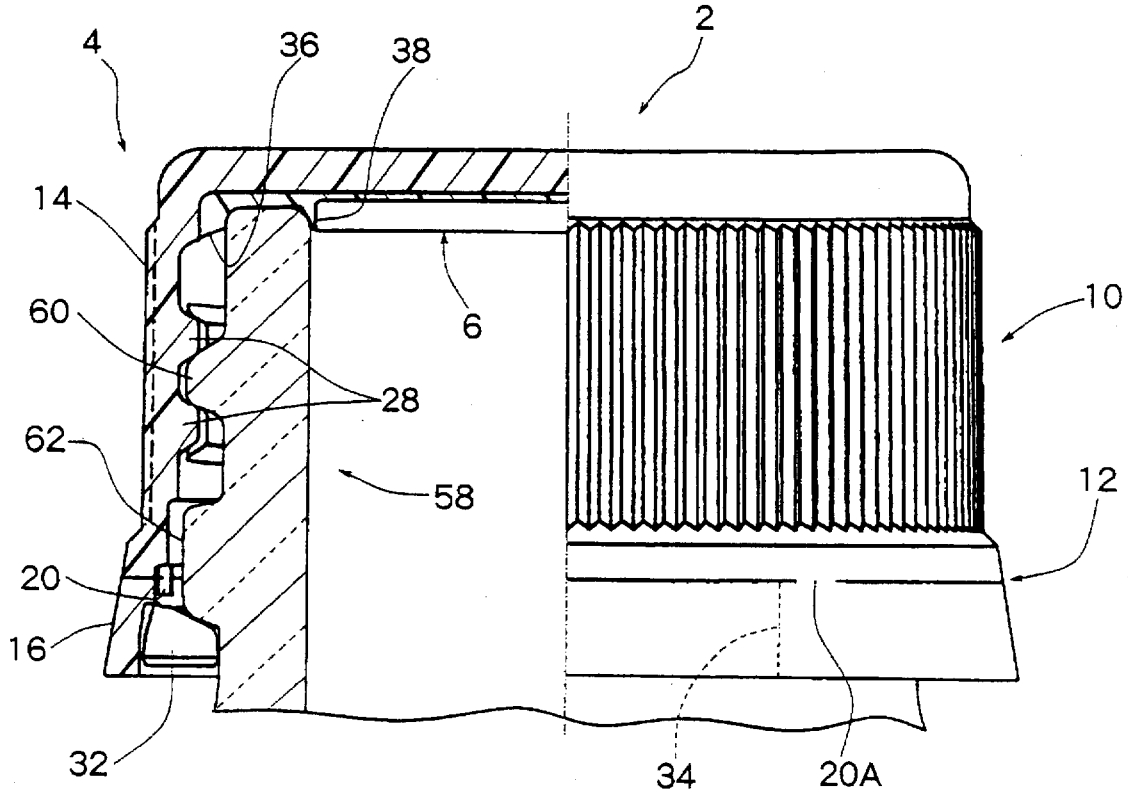
FIG. 5 is a side view partly in section of the state in which the container closure of FIG. 1 has been mounted on the mouth-neck portion of a container.

FIG. 5 shows the state in which the container closure 2 described above is mounted on the mouth-neck portion 58 of a container. The mouth-neck portion 58 of a container, which may be formed of glass or a suitable plastic material such as polyethylene terephthalate, is nearly cylindrical as a whole. On its outer peripheral surface are formed an external thread 60, and an annular engaging jaw portion 62 located below it. After a desired thing such as a soft drink is filled into the container, the container closure 2 is mounted on the mouth-neck portion 58 to seal it. To mount the container closure 2 on the mouth-neck portion 58, the container closure 2 is put over the mouth-neck portion 58, and turned in a closing direction, that is, clockwise as viewed from above in FIG. 5. As a result, the internal thread 28 formed on the inner peripheral surface of the main portion 14 of the skirt wall 10 in the shell 4 is engaged with the external thread 60 formed on the outer peripheral surface of the mouth-neck portion 58 of the container. The engaging means 32 formed on the inner peripheral surface of the tamper-evident bottom portion 16 of the shell 4 pass over the annular engaging law portion 62 of the mouth-neck portion 58 in an elastically deformed condition. Then, they are elastically restored to their original form to come into engagement with the underside of the annular engaging jaw portion 62. The liner 6 disposed on the inner surface of the top panel wall 8 of the shell 4 has the outside sealing ridge 36 and inside sealing ridge 38 thereof intimately contacted with the upper end surface of the mouth-neck portion 58 to seal it.

To open the mouth-neck portion 58 of the container, the container closure 2 is turned in an opening direction, that is, counterclockwise as viewed from above in FIG. 5. By so doing, the internal thread 28 formed on the inner peripheral surface of the main portion 14 of the skirt wall 10 in the shell 4 is moved along the external thread 60 formed on the outer peripheral surface of the mouth-neck portion 58. Thus, the container closure 2 is moved upward as it is turned. When the container closure 2 is moved up to some extent and the liner 6 leaves the upper end surface of the mouth-neck portion 58, the inside of the container is allowed to communicate with the outside through the gap between the upper end surface of the mouth-neck portion 58 and the liner 6 as well as the venting notches 30 (FIG. 1) formed in the internal thread 28. The tamper-evident bottom portion 16 of the shell 4 is kept from moving upward, since the engaging means 32 formed on its inner peripheral surface are engaged with the underside of the annular engaging jaw portion 62 formed on the outer peripheral surface of the mouth-neck portion 58. Consequently, a considerable stress is exerted on the bridging portions 20 in the circumferential breakable line 12 formed in the skirt wall 10 of the shell 4, and all the bridging portions 20 are broken, except the nonbreakable bridging portion 20A. A considerable stress is also exerted on the axial breakable line 34 formed in the tamper-evident bottom portion 16 to break the axial breakable line 34, converting the tamper-evident bottom portion 16 from the endless annular form into a tape form. As a result, the engagement of the engaging means 32 with the annular engaging law portion 62 is released. Thereafter, the entire container closure 2 including the tamper-evident bottom portion 16 becomes free to move upward. Thus, the entire container closure 2 is removed from the mouth-neck portion 58 to open it.

Figure 6:
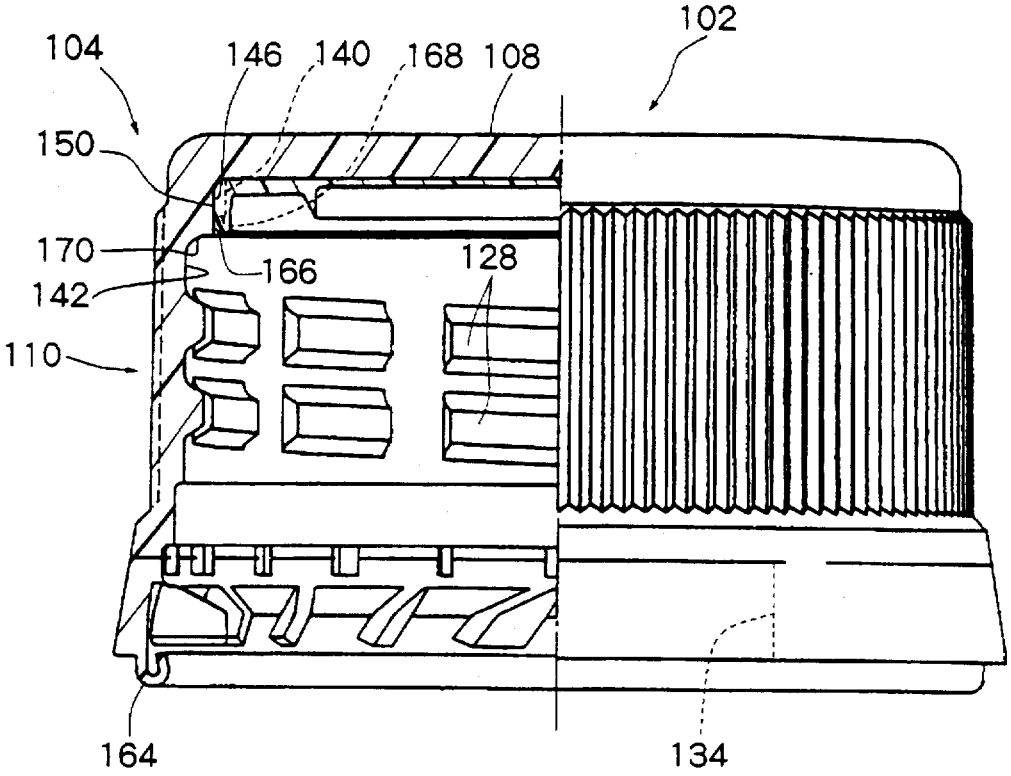
FIG. 6 is a side view partly in section of a second embodiment of the container closure improved in accordance with this invention.

FIG. 6 shows another embodiment of the container closure constructed in accordance with the present invention. In a shell 104 in the illustrated container closure 102, a curl 164 of a relatively small thickness is formed at the lower end of a skirt wall 110. The curl 164 known per se can be formed advantageously by forming a projecting portion by compression molding or injection molding so as to extend substantially straightly, and then deforming the projecting portion under heat. A score which defines an axial breakable line 134, may be extended to the curl 164. However, when the curl 164 has been formed by compression molding or injection molding, followed by deforming under heat, the curl 164 becomes considerably brittle because of the heat deformation. Hence, when the container closure is removed from the mouth-neck portion of the container, that part of the curl 164 which continues from the score located above the curl 164 is fully easily broken axially following the breakage of the score, even if a score or the like has not been formed in the curl 164.

Figure 7:
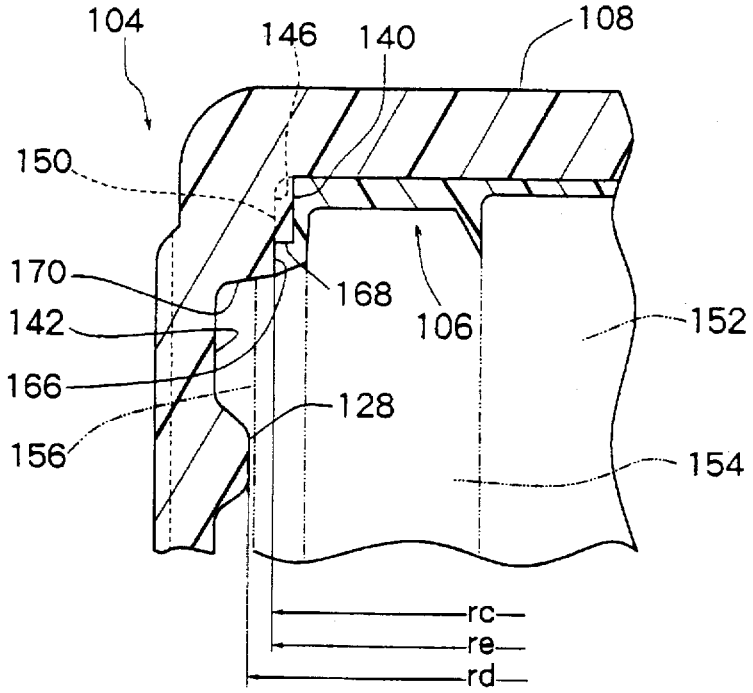
FIG. 7 is a partial longitudinal sectional view of the container closure illustrated in FIG. 6.
Figure 8:
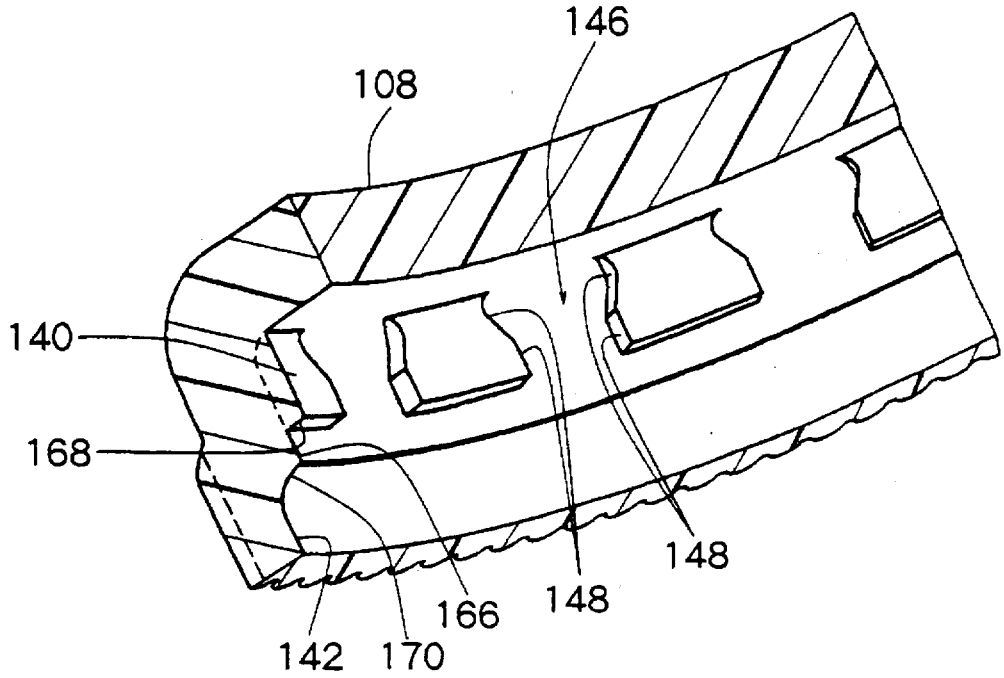
FIG. 8 is a partial perspective view of the shell in the container closure of FIG. 6.

With reference to FIGS. 7 and 8 along with FIG. 6, a transitional surface 166 disposed between an overhanging upper end surface 140 extending downwardly from the inner surface of a top panel wall 108 and a thread forming surface 142 located below the overhanging upper end surface 140 is formed on the inner peripheral surface of the skirt wall 110 in the shell 104 of the container closure 102. The transitional surface 166 is in the shape of a cylinder with the internal diameter re. A first annular shoulder surface 168 extending radially outwardly from the lower end of the overhanging upper end surface 140 to the upper end of the transitional surface 166 is defined between the overhanging upper end surface 140 and the transitional surface 166. A second annular shoulder surface 170 extending radially outwardly from the lower end of the transitional surface 166 to the upper end of the thread forming surface 142 is defined between the transitional surface 166 and the thread forming surface 142. A plurality of depressions 146 are formed at circumferentially spaced positions in the overhanging upper end surface 140. Advantageously, each of the depressions 146 extends upwardly from the lower end of the overhanging upper end surface 140 (accordingly, from the first annular shoulder surface 168). The depressions 146 extend upwardly as far as the inner surface of the top panel wall 108, but if desired, the upper ends of the depressions 146 may be located somewhat below the inner surface of the top panel wall 108. Both-side surfaces 148 of each depression 146, as clearly illustrated in FIG. 8, extend substantially vertically in the axial direction in the lower half portion of the depression 146. In the upper half portion of the depression 146, on the other hand, both-side surfaces 148 extend circumferentially outwardly and inclinedly in an axially upward direction. Thus, the depression 146 has a circumferential length increased upwardly in a part thereof (i.e., the part where both-side surfaces 148 extend circumferentially outwardly and inclinedly in an axially upward direction). If desired, it is possible to give a constitution in which both-side surfaces 148 of the depression. 146 extend circumferentially outwardly and inclinedly in an axially upward manner in the entire axial direction, so that the circumferential length of the depression 146 is gradually increased axially upwardly in the entire axial direction. In the radial direction, like the depression 46 in the container closure 2 mentioned previously, both-side surfaces 148 in the circumferential direction of each depression 146 are inclined circumferentially outwardly in a radially outward direction. Thus, the circumferential length of the depression 146 is gradually increased radially outwardly. Instead of gradually increasing the circumferential length of the depression 146 radially outwardly in the entire radial direction and in the entire axial direction, it is permissible, if desired, to increase the circumferential length of the depression 146 radially outwardly only in part of the radial direction or in part of the axial direction. As depicted in FIG. 7, it is preferred that the internal diameter rc of the outward end surface of the depression 146 is substantially equal to or smaller than the internal diameter re of the transitional surface 166, and the internal diameter re of the transitional surface 166 is substantially equal to or smaller than the internal diameter rd of the radially inward edge of the internal thread 128 formed on the thread forming surface 142, showing the relationship $rc \leqq re \leqq rd$. In this case, as will be easily understood by reference to FIG. 7, there will be additionally formed some undercut which will cause forced mold release in the molding of the shell 104, since both-side surfaces 148 of the depression 146 extend circumferentially outwardly and inclinedly in an axially upward direction in a part thereof. However, such an undercut is too small to cause an excessive forced mold release. Except this slight undercut, there will be no additional generation of an undesirable excessive undercut.

Figure 9:
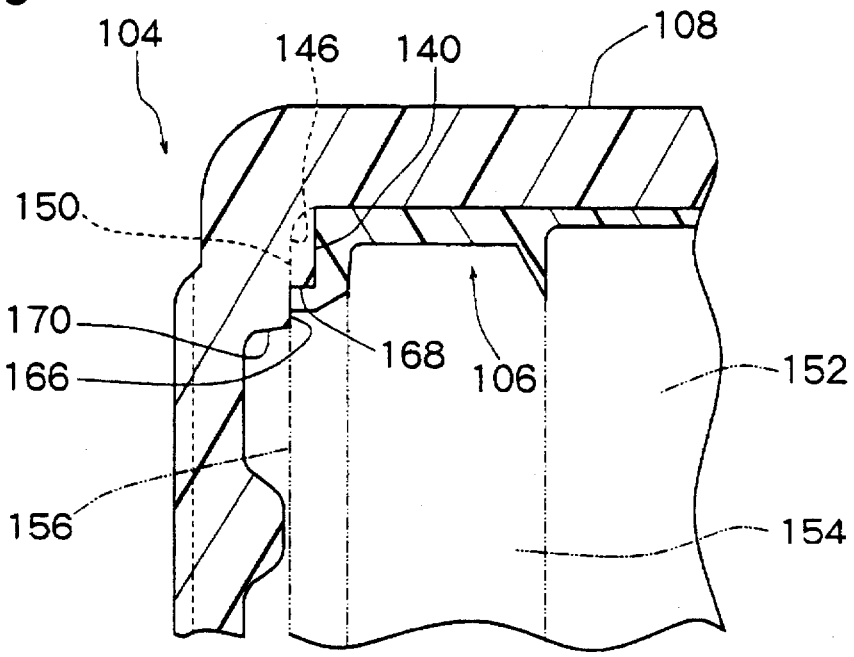
FIG. 9 is a partial longitudinal sectional view showing a modified example of the manner in which the liner is molded in the container closure of FIG. 6.

The depressions 146 are formed in the overhanging upper end surface 140 on the inner peripheral surface of the skirt wall 110 in the shell 104. On the outer peripheral surface of the liner 106 molded by making the plastic material fluid within the shell 104, therefore, a plurality of projections 150 defined by the plastic material flowing into the depressions 146 are formed in correspondence with the depressions 146. In molding the liner 106, as shown by the two-dot chain lines in FIG. 7, a compression molding tool comprising a columnar center punch 152, a cylindrical bushing 154 surrounding the center punch 152, and a cylindrical sleeve 156 surrounding the bushing 154 is inserted into the shell 104 to act on the plastic material, thereby making the plastic material fluid into a desired shape, as in the case of the container closure 2 already described. When the liner 106 is to be molded, the shell 104 is usually laid in an inverted state (the state of the outside surface of the top panel wall 108 facing downward) on an anvil (not shown), and the compression molding tool is lowered into the shell 104. On this occasion, before the center punch 152 and the bushing 154 are lowered to the illustrated positions, the sleeve 156 is lowered to the indicated position so that the lower end of the sleeve 156 is brought into intimate contact with the second annular shoulder surface 170. By so doing, the outflow of the plastic material, say, in a stringy form, through the second annular shoulder surface 170 can be prevented fully reliably. Instead of contacting the lower end of the sleeve 156 with the second annular shoulder surface 170, the outer peripheral surface of the sleeve 156 having an external diameter set to be substantially equal to the internal diameter re of the transitional surface 166 may be brought into fully intimate contact with the transitional surface 166, as illustrated by a two-dot chain line in FIG. 9. By so doing, the plastic material can be prevented from flowing out, say, in a stringy form, through the transitional surface 166. When the liner 106 is molded by lowering the sleeve 156 to the position shown in FIG. 7 or FIG. 9, the entire first annular shoulder surface 168 is covered with the plastic material forming the liner 106. If desired, the sleeve 156 is further lowered in FIG. 9, thereby making it possible to closely contact the outer peripheral surface of the sleeve 156 with the transitional surface 166, and to intimately contact the lower end of the sleeve 156 with the first annular shoulder surface 168. In this case, as in the aforementioned container closure 2, the first annular shoulder surface 168 is exposed downwards without being covered with the plastic material forming the liner 106, with the exception of the sites where the depressions 146 are formed.

Except the above-described constitution, the container closure 102 is substantially the same as the container closure 2 illustrated in FIGS. 1 to 5. In the container closure 102 improved in the aforesaid manner according to the present invention, the radially inward displacement of the peripheral edge portion of the liner 106 can be inhibited fully assuredly by the cooperative engagement between the plurality of depressions 146 formed in the overhanging upper end surface 140 on the inner peripheral surface of the skirt wall 110 in the shell 104, and the plurality of projections 150 formed on the outer peripheral surface of the liner 106 in correspondence with the depressions 146. In addition, the axially downward displacement of the peripheral edge portion of the liner 106 can be inhibited fully assuredly. That is, since the circumferential length of the depression 146 is increased radially outwardly at least in part thereof, the radially inward displacement of the peripheral edge portion of the liner 106 can be inhibited fully assuredly by the cooperative engagement between the depressions 146 and the projections 150. Moreover, since the circumferential length of the depression 146 is increased axially upwardly at least in part thereof, the axially downward displacement of the peripheral edge portion of the liner 106 can be inhibited fully assuredly by the cooperative engagement between the depressions 146 and the projections 150. These effects result in fully reliably preventing the peripheral edge portion of the liner 106 from contractedly moving or inclining in the radial direction, or moving axially downwardly, when the liner 106 molded by pressing and making the plastic material fluid into a desired shape within the shell 104 hardens. Thus, the liner 106 having the desired satisfactory sealing properties is molded stably. Furthermore, the liner 106 is fully reliably prevented from undergoing an undesirable movement during the transportation of the container closure 102, or when the container closure 102 is mounted on the mouth-neck portion of a container, or when the container closure 102 is released from the mouth-neck portion of the container.

In the container closure of the present invention, the contracted movement or inclination of the peripheral edge portion of the liner being molded is prevented fully reliably, whereby the desired sealing properties are achieved stably. Also, the plastic material pressed within the shell during the molding of the liner is prevented fully reliably from flowing out from the desired site, for example, in a stringy form, whereby the liner of a desired shape can be molded stably.

While the present invention has been described in detail hereinabove on the basis of the preferred embodiments with reference to the accompanying drawings, it should be understood that the invention is not limited to these embodiments, but various changes and modifications are possible without departing from the scope of the invention.

What we claim is:

1. A container closure comprising: a plastic shell having a top panel wall and a skirt wall extending downwardly from a peripheral edge of the top panel wall, and a plastic liner made of a plastic material is provided within the shell, wherein:

the skirt wall includes a plurality of depression defined at circumferentially spaced positions at an upper end portion of an inner peripheral surface of the skirt wall, wherein each of the depressions has an increasing circumferential length in at least a part of a radially outwardly direction and each of the depressions has an increasing circumferential length in at least a part of an upwardly direction, and wherein a plurality of projections defined by the plastic material at an outer peripheral surface of the liner are included in the depressions whereby such projections are formed by fluid flow of the liner into the depressions during molding.

2. The container closure of claim 1, wherein the depressions are spaced apart at equal distances in the circumferential direction.

3. The container closure of claim 1, wherein an overhanging upper end surface extending downwardly from an inner surface of the top panel wall and a thread forming surface located below the overhanging upper end surface are provided on the inner peripheral surface of the skirt wall; an annular shoulder surface extending radially outwardly is defined between the overhanging upper end surface and the thread forming surface; the depressions are defined in the overhanging upper end surface; an internal thread is provided on the thread forming surface; and an internal diameter rc of a radially outward end surface of each depression and an internal diameter rd of radially inward edge of the internal thread are in relationship such that rc≦rd.

4. A container closure comprising:

a plastic shell having a top panel wall and a skirt wall extending downwardly from a peripheral edge of the top panel wall; and a plastic liner made of a plastic material provided within the shell, wherein, the skirt wall includes a plurality of depressions defined at circumferentially spaced positions at an upper end portion of an inner peripheral surface of the skirt wall, wherein each of the depressions has an increasing circumferential length in at least a part of a radially outwardly direction and each of the depressions has an increasing circumferential length in at least a part of an upwardly direction, and wherein a plurality of projections defined by the plastic material at an outer peripheral surface of the liner are included in the depressions, whereby such projections are formed by fluid flow of the liner into the depressions during molding, wherein, an overhanging upper end surface extending downwardly from an inner surface of the top panel wall and a thread forming surface located below the overhanging upper end surface are provided on the inner peripheral surface of the skirt wall; an annular shoulder surface extending radially outwardly is defined between the overhanging upper end surface and the thread forming surface; the depression are defined in the overhanging upper end surface; an internal thread is provided on the thread forming surface; and an internal diameter rc of a radially outward end surface of each depression and an internal diameter rd of a radially inward edge of the internal thread are in a relationship such that rc≦rd, and wherein, a transitional surface located between the overhanging upper end surface and the thread forming surface is provided on the inner peripheral surface of the skirt wall, wherein the transitional surface is in the shape of a cylinder with an internal diameter re, and the internal diameters are in a relationship such that rc≦re≦rd.

* * * * *